US005624097A

United States Patent [19]

Potter

[11] Patent Number: 5,624,097

[45] Date of Patent: Apr. 29, 1997

[54] SHEET-SUPPORTING STAND

[76] Inventor: David J. Potter, 13 High Street, Loddon, Norfolk NR146ET, England

[21] Appl. No.: 265,841

[22] Filed: Jun. 24, 1994

[30] Foreign Application Priority Data

Jun. 26, 1993 [GB] United Kingdom ..... 9313260
Jun. 6, 1994 [GB] United Kingdom ..... 9411259

[51] Int. Cl.[6] ..... A47B 97/04

[52] U.S. Cl. ..... 248/464; 248/449; 248/451; 248/460; 280/47.24; 280/652; 280/767

[58] Field of Search ..... 248/460, 463, 248/464, 447, 448, 449, 451, 98, 439, 454, 455; 280/767, 47.24, 47.33, 63, 38, 652, DIG. 6

[56] References Cited

U.S. PATENT DOCUMENTS

| | | | |
|---|---|---|---|
| 1,992,108 | 2/1935 | White | 182/129 |
| 2,834,526 | 5/1958 | Paris | 182/129 |
| 3,145,966 | 8/1964 | Landon | 248/464 |
| 3,813,075 | 5/1974 | Capper | 248/451 X |
| 4,042,203 | 8/1977 | Warkentin | 248/463 X |
| 4,690,363 | 9/1987 | Koves | 261/449 |
| 5,219,142 | 6/1993 | Potter | 248/460 X |
| 5,232,065 | 8/1993 | Cotton | 280/DIG. 6 X |

*Primary Examiner*—Ramon O. Ramirez
*Assistant Examiner*—Korie H. Chan
*Attorney, Agent, or Firm*—William H. Eilberg

[57] ABSTRACT

A sheet-supporting stand or easel includes two or more legs, at least one of which is adjustable in length, so as to vary the angle of the stand relative to the ground. A U-shaped mast provides a carriage area for holding one or more sheets, and a pair of clamping devices, mounted to the mast, clamp the sheets from opposite sides. The legs can be collapsed and pivoted around their mounting to the mast, such that the entire assembly can be transported in a generally flat and compact configuration. A wheel may be attached to one or more of the legs, to facilitate movement of the stand along the ground. The wheel may be pivoted and held at any desired angle relative to the leg, such that the wheel may be kept away from the ground while the stand is in use.

14 Claims, 5 Drawing Sheets

Fig. 5a
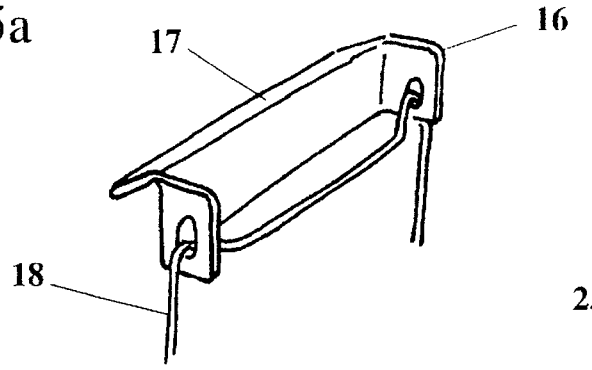
Fig. 5b
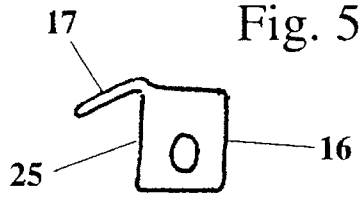
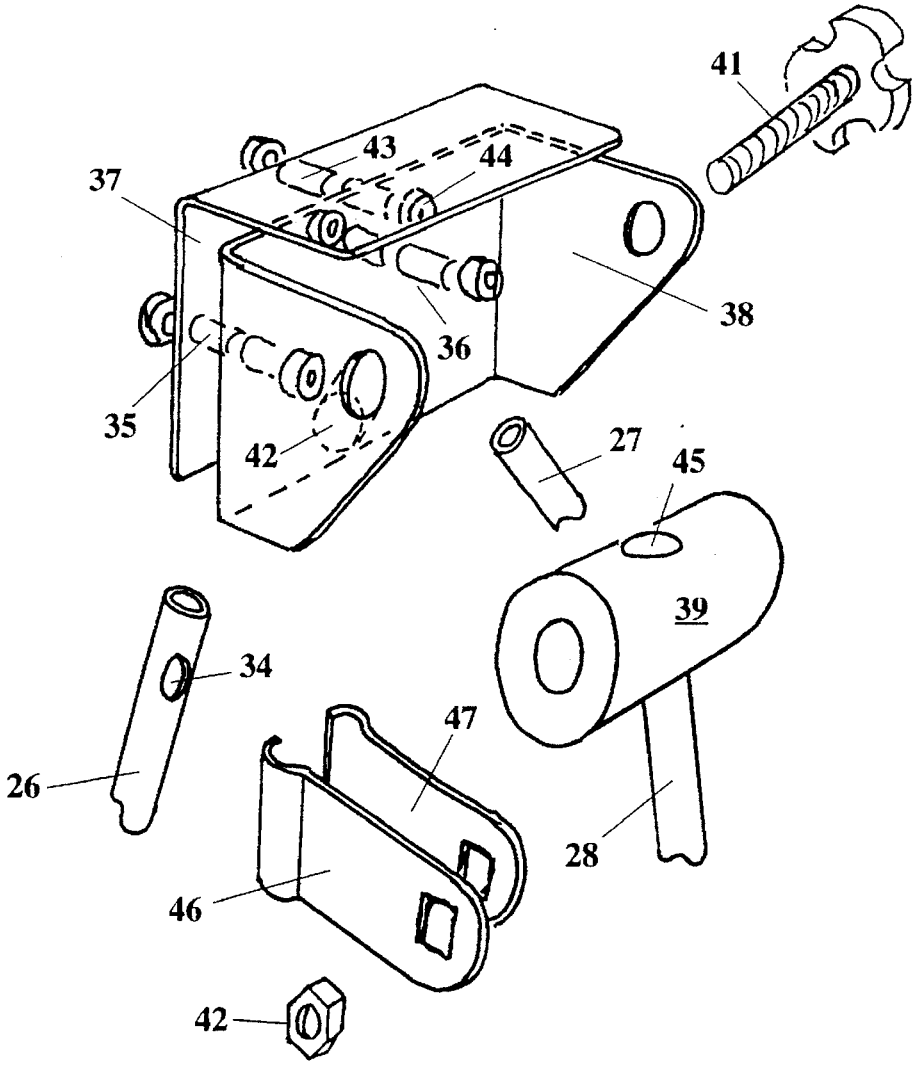
Fig. 5

SHEET-SUPPORTING STAND

BACKGROUND OF THE INVENTION

This invention is concerned with a new and inventive sheet-supporting stand which may be used, for example, as an artist's easel, but which also can be used for other purposes, such as a music stand.

Artist's easels are traditionally relatively heavy, for stability in use, and therefore not easily carried by the user from one site of use to another. Music stands, by contrast, are all too often of a flimsy light-weight construction, precisely because they have to be carried around from one performance to another, and are notoriously unstable. The present invention provides a sheet-supporting stand which is inherently stable, sufficiently rigid that it is not easily damaged in transit, readily portable, and equally applicable to usage as an artist's easel or a music stand.

There is no readily apparent way, in the prior art, of overcoming the conflicting characteristics of these known constructions, still less of combining them into an article equally at home in either environment. The present invention accomplishes the latter goal. As will become apparent, the product made according to the present invention achieves quite the opposite of the results obtained from conventional stands.

SUMMARY OF THE INVENTION

The invention includes a sheet-supporting stand which can be used as an artist's easel, a music stand, or the like. The sheet-supporting portion of the stand includes a U-shaped mast, at one end of which is a channel, the mast having a plate which slides thereon. The plate and the channel together define a clamp for sheet materials to be supported by the stand. An elastic cord extending between the channel and the plate tends to hold the plate and channel in a clamped position around the sheet material.

The stand has two or more legs, at least one of which is telescopically adjustable in length, so that the angle of the stand, relative to the ground, can be adjusted. Also, the legs can pivot, relative to the mast, so the angle of spreading can be varied. The stand can include one or more wheels, attached to one or more legs, the wheels being mounted to pivot relative to the legs. The wheels assist in transporting the stand, but can be positioned so that they do not contact the ground when the stand is in use.

The stand can be collapsed by telescoping the legs and pivoting them into the plane of the mast, such that the entire assembly is very compact and generally flat. The U-shaped end of the mast can act as a convenient handle for the stand when it is transported in its collapsed condition.

The invention therefore has the primary object of providing a stand for supporting sheet materials, such as an artist's canvas or sketch pad, or sheet music, or the like.

The invention has the further object of providing a stand which is adjustable in height, and which is stable when in use, and which reliably supports sheet materials of varying sizes.

The invention has the further object of providing a stand which is easily collapsed into a very compact and generally flat structure to be transported.

The reader will recognize other objects and advantages of the invention, from a reading of the following brief description of the drawings, the detailed description of the invention, and the appended claims.

BRIEF DESCRIPTION OF THE DRAWINGS

FIG. 5 is an exploded and partially schematic view showing the manner in which the components of the mechanisms of FIGS. 3 and 4 interact.

FIG. 5*a* is a perspective view of the plate which helps to clamp a sheet onto the stand.

FIG. 5*b* is an end view of the plate of FIG. 5*a*.

DETAILED DESCRIPTION OF THE INVENTION

The sheet-supporting stand of the present invention is essentially a tripod-style article in which three spaced-apart legs support, in use, an essentially rectangular elongate mast 1 whose attitude relative to the ground can be varied and selectively fixed by the user. For example, if the stand is used as an easel, the artist can rest his or her canvas or sketch pad on the mast, while working, at the most comfortable angle.

In this specification, wherever the sheet material is identified as a canvas or sketch pad, it should be understood that any other kind of sheet material could be supported instead.

Figure 1:
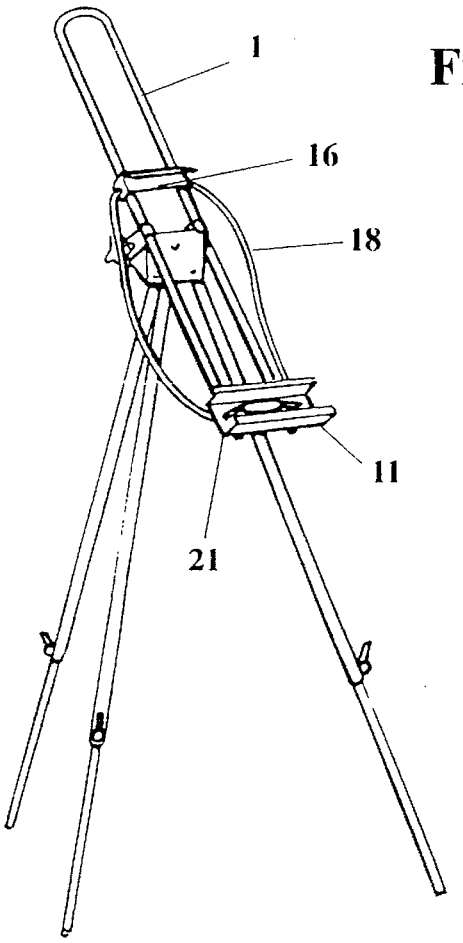
FIG. 1 provides a perspective view of the sheet-supporting stand of the present invention, in its upright, opened-out "in use" mode.
Figure 3:
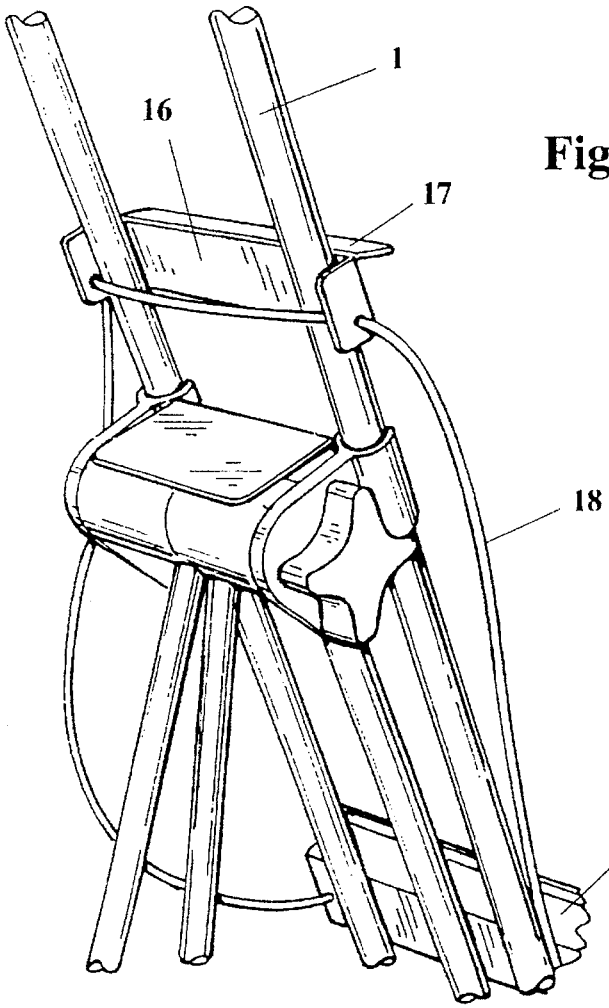
FIG. 3 provides a detailed perspective view, partially fragmentary, and enlarged in scale relative to FIGS. 1 and 2, showing the main mechanisms underlying the operation of the stand.

The mast 1 is an elongate, U-shaped item, which can be formed by bending a single and initially elongate linear run of hollow tubular steel. The facing opposite ends of the U are spanned and joined by a channel 11 illustrated in detail in FIG. 7 but also readily visible in FIGS. 1, 3, and 4.

Figure 7:
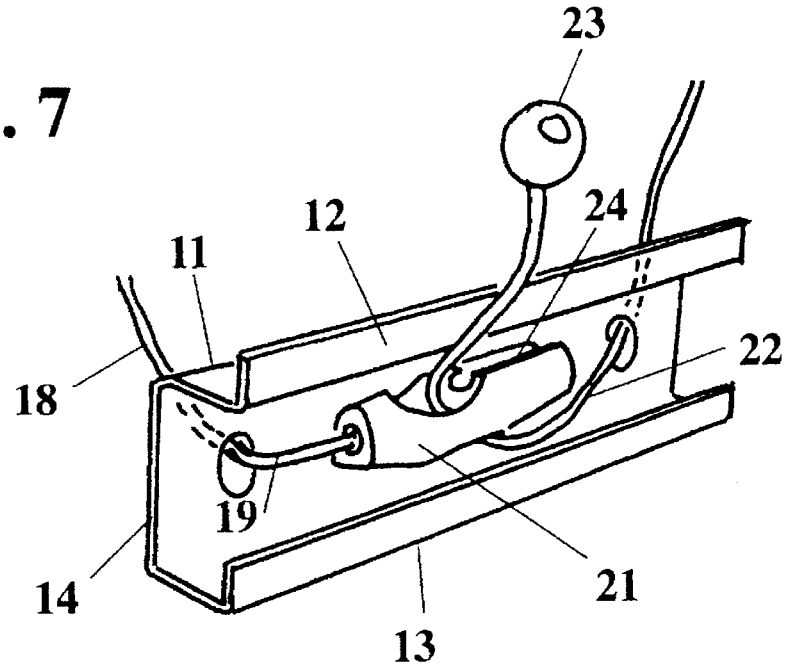

The channel 11 is itself U-shaped in cross-section, as FIG. 7 clearly shows. The opposite sides of the channel are flanged outwardly, each in the same general direction, to form respective lips 12 and 13 (the lip 13 being shown partly cut-away in FIG. 7, for purposes of clarity). The lips 12 and 13 extend fully along their respective channel side walls. The channel itself is rectangular when viewed from its top or bottom, and its walls each extend at a right angle to its base.

Figure 4:
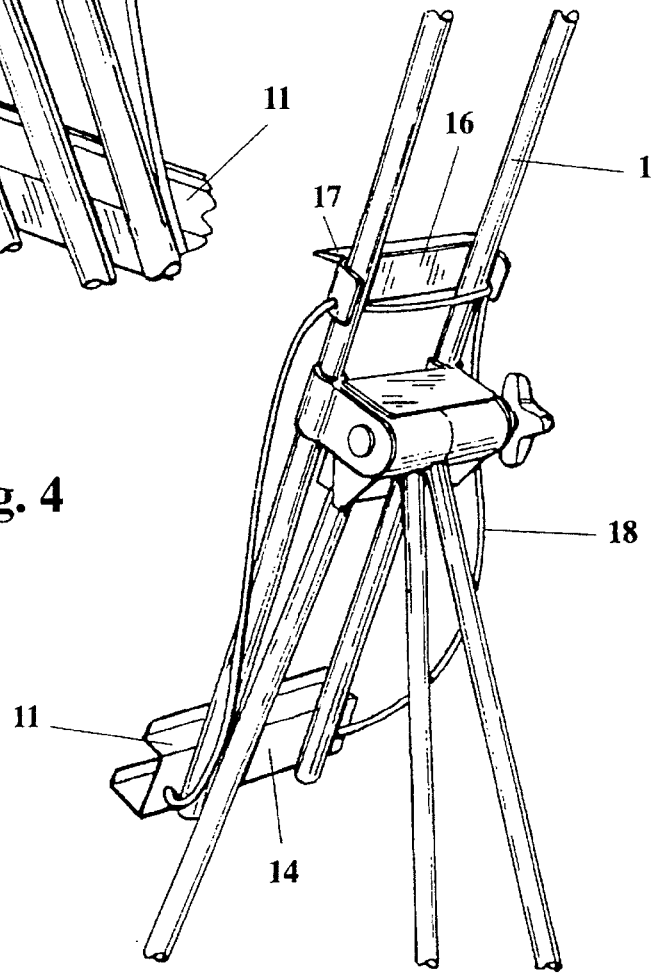
FIG. 4 is another detailed fragmentary perspective view of the stand, also enlarged in scale relative to that of FIGS. 1 and 2.

The underside 14 of the base is welded to a part of the outside wall of each of opposite-end tube runs of the mast as shown particularly directly in FIG. 4. This construction forms the mast into a relatively rigid, elongate U-shape whose limbs are parallel and spaced sufficiently far apart to support an artist's canvas or sketch pad, while being sufficiently close to one another to define a relatively slim overall rectangle.

Slidable up and down the mast is a pressed steel plate 16 shown most clearly in FIGS. 5*a* and 5*b*. The plate 16 is a U-shaped plate and is so sized that its base spans the tubes of the mast at right angles and its upturned opposite end pieces embrace the mast so that the plate easily fits slidingly along the length of the mast.

The plate 16 has a lip 17 bent up from the base of its principal U-shape and extending, in the embodiment shown, along the length of the plate. In use, the channel 11 supports the bottom edge of the artist's canvas or sketch pad (or other sheet material to be supported) while the underside of the lip 17 clamps against the top edge of the canvas or pad. In addition to being supported from behind by the tubes forming the mast, the canvas or pad (or other sheet) is thereby held securely against the mast.

The clamping action of the channel 11 and plate 16 is achieved by virtue of an elongate elastic cord 18 which runs between the channel 11 and the plate 16. One end of this cord is fixed into a plastic toggle 21 which sits inside the channel 11. From this end of the toggle, the cord 18 emerges through the channel base plate, as shown in FIG. 7, to run up and alongside the mast, into and across the plate 16 (between the opposite upturned ends of the plate), and down alongside the other mast tube to re-enter the channel 11 as indicated at 22 in FIG. 7.

The cord indicated at 22 then enters the toggle 21 again, as shown in FIG. 7. But it is not, like the cord end 19, fixed to the toggle. There is a sufficiently large gap in the bottom of the toggle for the cord end 22 to pass freely through the gap and emerge as shown in FIG. 7 to be capped with a pull-cap 23.

A channel 24 is formed in the top of the toggle 21 as shown. The size and cross-sectional shaping of the channel is such that the inherently resilient elastic cord 18 will co-act with the relatively solid but still resilient walls of the channel 24 to enable the cord end 22 to be trapped and releasably held in the channel 24, once the length of the cord has been adjusted to position the plate 16 and channel 11 sufficiently far apart to accommodate the canvas or sketch pad being supported.

The inherently elastic nature of the cord 18 enables the plate 16 to be "stretched" over the top edge of the canvas or sketch pad, once the overall length of the cord has been temporarily fixed by adjusting and then trapping the cord end 22 in the channel 24. The adjustment facility provided by the toggle 21 enables the plate 16 and channel 11 to accommodate a wide range of sizes of canvas or sketch pad or other sheet material.

As shown in FIG. 5, the holes in the plate-ends, through which the cord 18 runs, are positioned close to the front surface 25 of the plate. The cord 18 enters each of these holes from outside, as shown in FIG. 5, and in FIGS. 3 and 4, and so runs between the upturned opposite ends of the plate 16, and the adjacent mast tubes they embrace, before it emerges to span the mast tubes from behind, as shown in these same figures. If the upturned ends of the plate 16 are made a sufficiently close embracing fit over the mast tubes, the sections of cord 18 effectively trapped between the upturned plate-ends and the adjacent mast tubes will act as a brake on the sliding plate when in use, as well as preventing the plate from falling off the mast by maintaining the span-section of cord run relatively taut in these circumstances.

Figure 6:
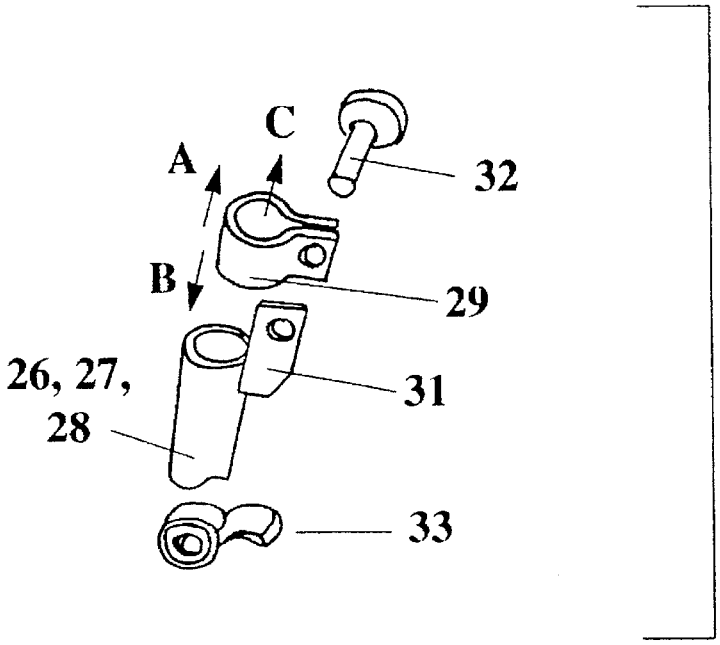
FIG. 6 and 7 provide sketches showing detailed features of the stand of the present invention, which features are not readily apparent from the other figures.

The mast is adjustable in height on its tripod legs, and the legs themselves are adjustable in their degree of expansion, as well as being individually telescopic and hence adjustable in overall individual length. FIGS. 5 and 6 show how these features are achieved.

Each leg 26, 27, and 28 is formed in two portions which telescope. The top-most portion of each leg (i.e. the portion closest to the region where they each join the mast) fits over the smaller-diameter leg extremity. This small-diameter ground-contacting portion of the leg is adjustably held within the outer main portion by virtue of a U-shaped plastic clamp 29 through which the leg extremity can slide freely and which is itself secured to the end of the main leg portion via a tab 31 welded to and projecting from the main portion end region as shown in FIG. 6.

The clamp 29 is held by a bolt 32 and manually easily operated wing nut 33. Tightening this bolt and wing nut assembly has the twin effects of tightening the plastic clamp 29, and hence fixing the telescoping portions of the leg rigidly to one another, and tightening the clamp 29 itself against its tab 31.

Releasing the bolt and wing nut assembly by slackening the wing nut 33 has the effect of easing the clamping action of the clamp 29. The ground-contacting leg portion can therefore easily be slid farther into the main leg portion as long as the wing nut 33 remains slackened. If it is pulled out, however, in an attempt to extend the leg, then the fitting and positioning of clamp 29 on tab 31 is such that the deliberately allowed axial play between the clamp and the adjacent leg-end will cause the clamp to tend to pivot about the axis of the bolt 32 as indicated by arrow A in FIG. 6.

The minimal pivoting action will tend to jam the otherwise extending ground contacting leg in its tube 26 (or 27 or 28). In order to extend the leg at all, the clamp 29 must be held against the adjacent leg-end by pressing down on it in the direction of arrow B in FIG. 6.

The leg extremity can then be pulled out and extended as indicated by arrow C, and the wing nut 33 then tightened again to fix it in its selected position.

This self-jamming action of the clamp 29 is well known from other industrial applications. Its big advantage is that the legs cannot inadvertently extend when, for example, any one or more of the wing nuts 33 is slackened and the stand is picked up with this fact unknown to the carrier. With easels or stands of the prior art, the latter situation generally results in the leg shooting out and painfully hitting the user's foot, for example. This accident cannot happen with the construction of the present invention.

By the same token, artists' easels with extendible legs conventionally have a screw-clamp making direct screw-end point contact with the leg, the screw having entered the main leg tube 26 (or 27 or 28) via a tapped boss on the main leg wall. Repeated high-pressure point contact to achieve the desired leg extension and clamping action results very often in the breakage of the screw clamp and/or the permanent distortion of the relatively easily deformed inner tubular leg portion. Again, this cannot happen with the construction illustrated here, because the clamping action is largely equally spread around the entire periphery of the inner tubular leg wall.

FIG. 5 shows a mounting assembly which connects the legs to the mast. As shown in FIG. 5, the two legs 26 and 27 are each drilled through as illustrated at 34 and are thereby pinned by respective bolts 35 and 36 between two main frame plates 37 and 38. The third leg 28 enters, radially, a relatively large elongate circular-cylindrical boss 39 which is itself pinned between the opposite upturned arms of the U-shaped plate 38 by the clamping action of the bolt and wing nut assembly 41 and 42. As illustrated, the nut 42 of this assembly fits over the end of the bolt 41, as shown, while the bolt 41 rotates with the winged hand-turned handle illustrated. The bolt itself could be permanently fixed in pace and the winged handle could rotate on it, as is more conventional, and as is the case with the leg-clamping bolt and nut 32 and 33.

The two main plates 37 and 38 are spanned by and held together by a third nut and bolt assembly 43, in addition to the two leg pivot nut and bolts 35 and 36. Assembly 43, which comprises a third pinning unit, serves both to hold together the spaced-apart plates 37 and 38 and to act as a stop for the outward pivoting spreading movement of the legs 26 and 27 if the pivot points defined by holes 34 are spaced sufficiently far from the leg-ends for those ends to abut the pinning unit 43 as the legs swing outwards.

The head 44 of the pinning bolt assembly 43 can also similarly act as a stop limiting the outwardly swinging spreading movement of the third leg 28, by virtue of the fact that the slightly protruding end 45 of the leg 28 will contact the head 44 of the bolt 43 and be prevented from rotating any farther.

The legs 26 and 27 spread out in the same plane, while the spreading movement of the leg 28 is, of course, at right angles to that plane.

In addition to providing a pivot axis for the boss 39 carrying the leg 28 between the upturned arms of the U-plate 38, the bolt 41 traps two clamps, each on a respective outer face of the upturned U-ends of that same plate 38. One of these clamps is shown in FIG. 5 to consist of two opposed plates 46 and 47 whose oppositely curved ends embrace and clamp one of the tubes of the mast. The other clamp, not shown in FIG. 5 for clarity, is of identical construction and its oppositely curved ends embrace and clamp releasably the other tube of the mast.

Slackening the nut and bolt assembly 41, 42 thus has the combined effects of allowing the leg 28 to swing and allowing the mast to slide for height adjustment, as well as to pivot for attitude adjustment relative to the ground. Adjustment of the canvas-clamping mechanism formed by channel 11 and plate 16 with cord 18 i s independent of the fixing or releasing of the bolt and wing nut 41, 42 and so is spreading of the legs 26 and 27 similarly unaffected by the state of the bolt and nut 41, 42.

Figure 2:
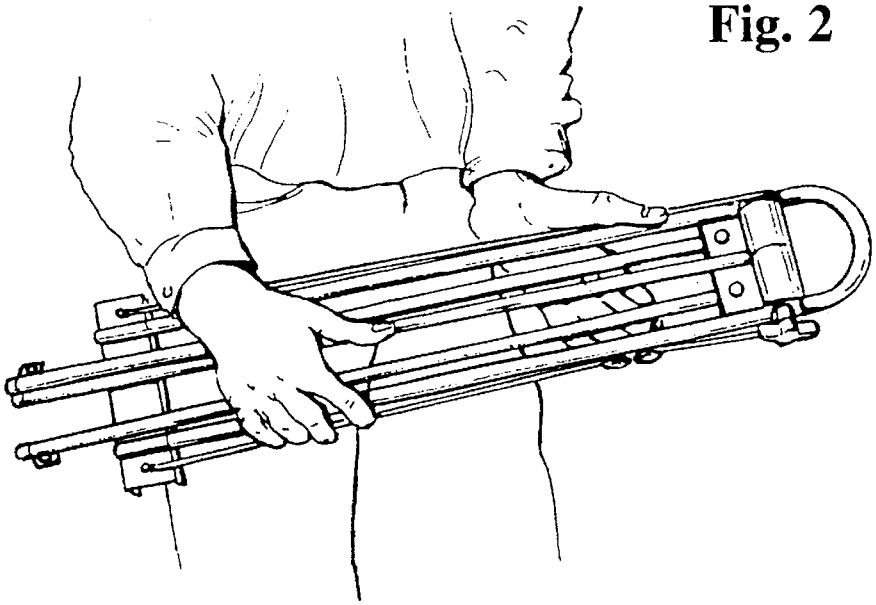
FIG. 2 provides a perspective view of the stand of the present invention when folded into its minimum overall dimensions for ease of carrying between sites of use, the figure also showing, in perspective, a fragment of a user carrying the folded stand.

When collapsed to its minimum overall dimensions, the stand of the present invention forms an exceptionally compact and easily stowed or carried unit, as shown in FIG. 2. The U-region of the mast also forms an extremely convenient carrying handle at one end of the stand, when the stand is so collapsed. The top surface of the channel 11 (the one exhibiting the lip 12) can act as a convenient tray for paint brushes, since it is large enough to do this as well as to accommodate a normal-thickness canvas or sketch pad, and the lip 12 can positively retain a paint brush on that surface. The clamps 46 and 47, and the plate 16, are each preferably coated with PVC so as not to scratch unduly the protected outer surface of the mast tubes, as these components slide along one another during adjustment in use.

Figure 8:
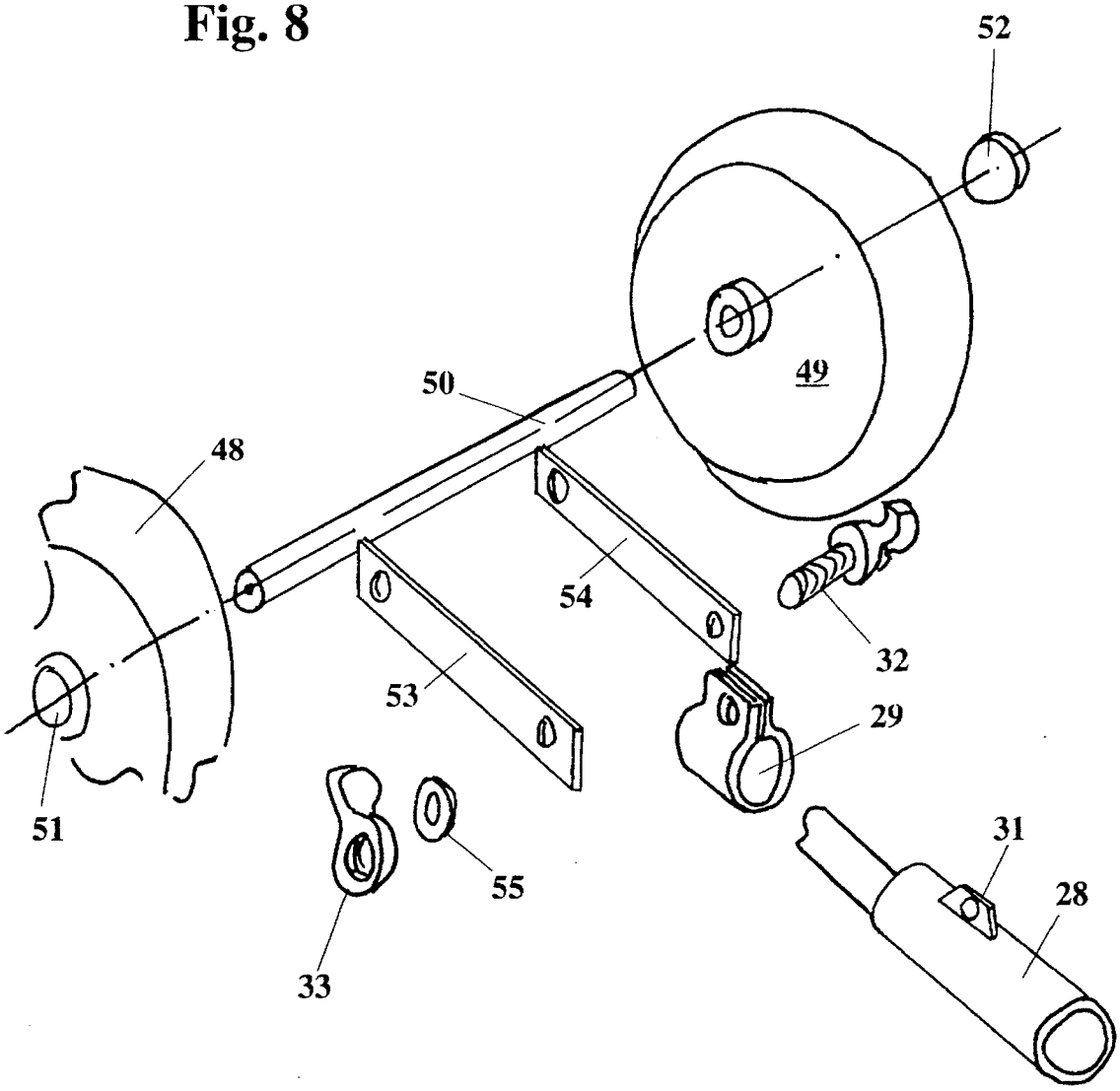
FIG. 8 is an exploded and partially schematic illustration of a wheel mechanism on the length-adjustable leg of the stand of the present invention.

In order to improve the portability of the stand still further, a pair of small wheels can be fitted to the leg 28, so that the collapsed stand can be "trailed along" behind the user. FIG. 8 shows an exploded view of a suitable wheel arrangement.

Two small wheels 48 and 49 are fixed to axle 50 by means of two end studs 51 and 52, so that both wheels are freely rotatable.

Two elongate support members 53 and 54 each have a hole at each of their ends, the holes in one support member being lined up along the same axes as the holes in the other.

The axle 50 passes through the holes in one end of both support members 53 and 54. The other end of support members 53 and 54 is attached to one of the length-adjustable legs, preferably leg 28. This is done by means of the clamping arrangement (described above), where bolt 32 passes not only through clamp 29 and tab 31, but also through the coaxial holes in the support members 53 and 54.

Releasing the bolt and wing nut assembly 32, 33 now has the additional effect of allowing the wheel assembly (i.e. wheels 48 and 49, axle 50, end studs 51 and 52, and support members 53 and 54) to be swung away from leg 28 so that it projects at an angle from the general axis of leg 28. Tightening the bolt and wing nut assembly enables the wheel assembly to be held in position, for example, at a right angle to the axis of leg 28.

In this way, the wheel assembly can be fixed in position such that it does not contact the ground when the stand is in use.

When the stand is to be transported to another location, the bolt and wing nut assembly can be released in order to swing the wheel assembly into a position generally in line with the axis of leg 28. Once the bolt and wing nut assembly has been tightened to hold the wheel assembly in place, the stand can then be easily "trailed along" behind the user who uses the U-region of the mast as a handle.

The invention can be modified, within the scope of the above disclosure. The materials used to make the stand can be changed, for example. The number of legs could be varied. The specific clamping structures could be modified also. These and other modifications, which should be apparent to those skilled in the art, should be considered within the spirit and scope of the following claims.

What is claimed is:

1. A sheet-supporting stand, comprising:

a pair of side legs and a rear leg, the rear leg having an end affixed to a cylindrical boss, the side legs having free ends, the side legs being pivotably mounted on pivot means, wherein a first angle between the side legs can be adjusted by pivoting one or both of the side legs, a sheet supporting element, the boss being held between two pairs of plates, each pair of plates including means for holding the sheet-supporting element between members of said each pair of plates, and means for tightening the pairs of plates, the tightening means comprising means for simultaneously tightening both the cylindrical boss and the sheet-supporting element in a fixed position, the tightening means also simultaneously fixing a second angle made by the rear leg relative to a plane defined by the side legs.

2. The sheet-supporting stand of claim 1, wherein the rear leg is free of direct contact with the plates.

3. The sheet-supporting stand of claim 1, wherein the side legs are free to pivot about the pivot means independently of a position of the tightening means.

4. The sheet-supporting stand of claim 1, wherein the sheet-supporting element comprises a generally U-shaped member, the U-shaped member having a channel mounted transversely across the U-shaped member and being rigidly affixed to the U-shaped member, the sheet-supporting stand further comprising a plate mounted transversely across the U-shaped member and being movable along the U-shaped member, and an elastic cord threaded through both the channel and the plate and extending between the channel and the plate, wherein the cord is wedged between the plate and the U-shaped member so as to stabilize the plate at a desired position along the U-shaped member, wherein a distance between the channel and the plate can be adjustably fixed.

5. The sheet-supporting stand of claim 1, wherein the sheet-supporting element comprises a U-shaped member defining an area, wherein all of the legs are pivotable, and wherein the stand includes means for pivoting the legs into a position such that the legs are substantially within a same plane and within the area defined by the U-shaped member.

6. A sheet-supporting stand, comprising:

a pair of side legs and a rear leg, the side legs and rear leg being arranged in a tripod configuration to define an apex, a mast which comprises a generally U-shaped member including a pair of generally parallel longitudinal members and a transverse member connecting the longitudinal members, the mast being mounted in a vicinity of said apex, the mast comprising means for supporting a sheet material, a channel mounted transversely across the longitudinal members of the mast, the channel being rigidly affixed to the mast, a plate mounted transversely across the longitudinal members of the mast, the plate being movable along the mast, and an elastic cord threaded through both the channel and the plate and extending between the channel and the plate, wherein the cord is wedged between the plate and the mast so as to stabilize the plate at a desired position along the mast, wherein a distance between the channel and the plate can be adjustably fixed.

7. The sheet-supporting stand of claim 6, further comprising means for simultaneously tightening the rear leg and the mast in a fixed position.

8. The sheet-supporting stand of claim 7, wherein the side legs are pivotably mounted on pivot means located in a vicinity of said apex, and wherein the side legs are free to pivot about the pivot means independently of a position of the tightening means.

9. A sheet-supporting stand, comprising:

a pair of side legs and a rear leg, the side legs and rear leg being arranged in a tripod configuration to define an apex, the side legs and the rear leg having free ends, the side and rear legs being substantially straight, and a mast which comprises a generally U-shaped member including a pair of generally parallel longitudinal members and a transverse member connecting the longitudinal members, the mast being mounted in a vicinity of said apex, the mast comprising means for supporting a sheet material, the mast defining an area, wherein all of the legs are pivotable, and the stand includes means for pivoting the legs into a position such that the length of the legs are substantially within the same plane and within the area defined by the mast.

10. The sheet-supporting stand of claim 9, wherein the side legs are mounted for pivoting movement within a first plane, and wherein the rear leg is mounted for pivoting movement within a second plane, the second plane being generally perpendicular to the first plane.

11. The sheet-supporting stand of claim 9, further comprising means for simultaneously tightening both the rear leg and the mast in a fixed position.

12. The sheet-supporting stand of claim 9, further comprising a plate mounted transversely across the mast and being movable along the mast, and an elastic cord threaded through both the transverse member and the plate and extending between the transverse member and the plate, wherein the cord is wedged between the plate and the mast so as to stabilize the plate at a desired position along the mast, wherein a distance between the transverse member and the plate can be adjustably fixed.

13. A sheet-supporting stand comprising:

a pair of side legs and a rear leg, the rear leg having an end affixed to a cylindrical boss, the side legs being pivotably mounted on pivot means, a sheet supporting element the boss being held between two pairs of plates, each pair of plates including means for holding the sheet-supporting element between members of said each pair of plates, and means for tightening the pairs of plates, the tightening means comprising means for simultaneously tightening both the cylindrical boss and the sheet-supporting element in a fixed position, wherein the sheet-supporting element comprises a generally U-shaped member, the U-shaped member having a channel mounted transversely across the U-shaped member and being rigidly affixed to the U-shaped member, the sheet-supporting stand further comprising a plate mounted transversely across the U-shaped member and being movable along the U-shaped member, and an elastic cord threaded through both the channel and the plate and extending between the channel and the plate, wherein the cord is wedged between the plate and the U-shaped member so as to stabilize the plate at a desired position along the U-shaped member, wherein a distance between the channel and the plate can be adjustably fixed.

14. A sheet-supporting stand, comprising:

a pair of side legs and a rear leg, the side legs and rear leg being arranged in a tripod configuration to define an apex, and a mast which comprises a generally U-shaped member including a pair of generally parallel longitudinal members and a transverse member connecting the longitudinal members, the mast being mounted in a vicinity of said apex, the mast comprising means for supporting a sheet material, the mast defining an area, wherein all of the legs are pivotable, and the stand includes means for pivoting the legs into a position such that the legs are substantially within the same plane and within the area defined by the mast, further comprising a plate mounted transversely across the mast and being movable along the mast, and an elastic cord threaded through both the transverse member and the plate and extending between the transverse member and the plate, wherein the cord is wedged between the plate and the mast so as to stabilize the plate at a desired position along the mast, wherein a distance between the transverse member and the plate can be adjustably fixed.

* * * * *